US006999092B2

(12) United States Patent
Hagiwara

(10) Patent No.: US 6,999,092 B2
(45) Date of Patent: Feb. 14, 2006

(54) IMAGE DISPLAY APPARATUS IN WHICH A SPECIFIC AREA DISPLAY ATTRIBUTE IS MODIFIABLE

(75) Inventor: Kunihiko Hagiwara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 320 days.

(21) Appl. No.: 10/280,128

(22) Filed: Oct. 25, 2002

(65) Prior Publication Data

US 2004/0080515 A1 Apr. 29, 2004

(51) Int. Cl.
*G09G 5/00* (2006.01)

(52) U.S. Cl. ..... 345/581; 345/699; 348/565; 348/576; 348/208.13; 348/333.11

(58) Field of Classification Search ..... 345/3.4, 345/581, 698, 699; 348/208.13, 333.11, 348/333.12, 565–568, 576, 577
See application file for complete search history.

(56) References Cited

U.S. PATENT DOCUMENTS 6,226,040 B1 * 5/2001 Kuo et al. ..... 348/446
6,356,314 B1 * 3/2002 Takebe ..... 348/564
2002/0122041 A1 * 9/2002 Kai et al. ..... 345/581

FOREIGN PATENT DOCUMENTS

JP 9-307810 11/1997

* cited by examiner

*Primary Examiner*—Matthew C. Bella
*Assistant Examiner*—Gregory F. Cunningham
(74) *Attorney, Agent, or Firm*—Staas & Halsey LLP

(57) ABSTRACT

In an image display apparatus in which a display attribute of a specific area of the display can be modified based on an information input from a processor, a resolution of the image is determined from the input vertical and horizontal synchronization signals, dot clocks are generated by multiplying the horizontal synchronization signals depending on the determined resolution, a horizontal display period in one horizontal synchronization signal is detected using a signal in the image signals input from the processor, the actual count value of the dot clocks in the detected horizontal display period is compared with a standard value thereof in the horizontal display period in one line at the determined resolution of the image and the multiplication number of a dot clock generation circuit is corrected so that the count value coincides with the standard value to modify the display attribute of the specific area of the display.

8 Claims, 16 Drawing Sheets

IMAGE DISPLAY APPARATUS IN WHICH A SPECIFIC AREA DISPLAY ATTRIBUTE IS MODIFIABLE

BACKGROUND OF THE INVENTION

1. Field of the Invention

The present invention relates to an image display apparatus and, in particular, it relates to an image display apparatus in which a display attribute of a specific area is modifiable and which has function to correct the position of the specific area.

2. Description of the Related Art

Conventionally, an image display apparatus such as a display using a cathode-ray tube ("CRT display" below) or a liquid crystal display is connected to an information processor such as a personal computer via an analog interface. The display attributes (contrast or brightness or the like) of the specific area of a picture on the display apparatus can be modified. In an example, if a DVD (Digital Versatile Disc) image reproduced by a personal computer is displayed in a window defined in the CRT display screen, the display attribute is modified in such a way that the brightness of the portion of the window in which the DVD image to be reproduced is increased.

As described above, in an arrangement in which the display attribute of the specific area of a picture on an image display component is modified on the image display apparatus side, a display control circuit which outputs an image signal and a synchronization signal and a communication circuit which outputs a specific position information to the image display apparatus are provided in a personal computer. These signals are transmitted to the image display apparatus via a USB or a DDC. On the other hand, the image display apparatus comprises a communication circuit which receives the position information of the specific area from the personal computer, a display attribute control signal generation unit which generates a display attribute control signal, based on the position information and the synchronization signal, a circuit which converts the display attribute using the display attribute control signal, and an image display apparatus (below "display") such as a CRT display or a liquid crystal display which displays an image.

The display attribute control signal generation unit comprises a microcomputer, a PLL circuit, a register, and a display attribute control signal generation circuit. The microcomputer stores the position information of the specific area which is supplied from the communication circuit in the register. The microcomputer determines a resolution based on the timing of the synchronization signal supplied from the personal computer, and stores values of the horizontal cycle time, the vertical back porch, and the horizontal back porch of the resolution.

The PLL circuit generates a dot clock DC, which is necessary for generating the display attribute control signal, from the horizontal cycle time stored in the register and the horizontal synchronization signal sent from the personal computer. The display attribute control signal generation circuit generates the display attribute control signal from the dot clock DC generated in the PLL circuit, the horizontal and vertical synchronization signals sent from the personal computer, and the position information, vertical back porch and horizontal back porch stored in the register. The dot clock DC is generated by multiplying the frequency of the horizontal synchronization signal, in the PLL circuit, according to the horizontal cycle time of the resolution determined by the microcomputer.

A picture displayed on the display is determined by a plurality of horizontal synchronization signals and a vertical synchronization signal. Accordingly, when the display attribute of the specific area of the picture on the display is modified on the image display apparatus side, the microcomputer counts the horizontal synchronization signals for the vertical back porch in response to the vertical synchronization signal, and therefore counts the horizontal synchronization signals to the start point of the specific area in the Y direction (vertical direction).

After counting the horizontal synchronization signal to the start point of the specific area in the Y direction (vertical direction), the dot clocks DC for the horizontal back porch are counted in the horizontal synchronization signal at the start point of the specific area in the Y direction to detect the start point of the specific area in the X direction (horizontal direction). After the dot clocks DC are counted to the start point of the X direction, the display attribute control signal is set ON. The display attribute control signal is set OFF when the dot clocks DC are counted to the end point in the X direction of the specific area. Likewise, the display attribute control signal is set on or off for each line, and this is repeated to the end point of the specific area in the Y direction. In the conventional image display apparatus, the display attribute of the specific area of a screen on the display is charged in the way mentioned above.

However, in the conventional method, the timing of the image signal input from the personal computer can deviate from a standard. For example, the horizontal cycle time may be incorrect, or the value of the vertical back porch or the horizontal back porch can be different. In such cases, an area of the picture whose display attribute is to be modified is not identical to an area of the picture whose display attribute is actually modified on the screen of the display.

SUMMARY OF THE INVENTION

The present invention is intended to eliminate these drawbacks, in the conventional image display apparatus, by providing an image display apparatus in which, if the timing of the image signal transmitted to the image display apparatus from the personal computer deviates from a standard, the display attribute modification of the specific area can be correctly carried out in the picture on the display of the image display apparatus.

To achieve the purpose of the present invention, according to a first embodiment, there is provided an image display apparatus in which a display attribute of a specific area of the display can be modified based on an image signal input from an information processor, vertical and horizontal synchronization signals, and position information and display attribute information of the specific area, comprising:

- a resolution determination circuit which determines the resolution of the displayed image, based on the input vertical and horizontal synchronization signals,
- a dot clock generation circuit which generates dot clocks by multiplying the horizontal synchronization signal according to the determined resolution of the image,
- a horizontal display period detection circuit which detects a horizontal display period in one horizontal synchronization signal, using a signal in the image signal input from the information processor,
- a dot clock counting circuit which actually counts the number of the dot clocks detected in the horizontal display period,
- a dot clock standard value reading circuit which reads a standard value of the number of the dot clocks in the horizontal display period in a line at the determined resolution of the displayed image, and a correction circuit which corrects the multiplication number in the dot clock generation circuit so that the actually counted dot clock number is identical to the standard value.

A second embodiment of the present invention is an image display apparatus according to the first embodiment in which one signal, of the image signals, which detects the horizontal display period in one horizontal synchronization signal is one RGB signal.

A third embodiment of the present invention is an image display apparatus according to the first embodiment in which, if the number of the counted dot clocks is slightly different from the standard value, the correction circuit judges that the number of the counted dot clocks is equal to the standard value.

A fourth embodiment of the present invention is an image display apparatus according to the third embodiment in which the slight difference between the number of the counted dot clocks and the standard value corresponds to one pulse of the dot clock.

A fifth embodiment of the present invention is an image display apparatus according to the first embodiment in which the multiplication number is corrected by the correction circuit by dividing the standard value of the dot clock number by the actually counted number of the dot clocks, and multiplying the quotient by a current multiplication number of the dot clocks, to thereby obtain a multiplication number A sixth embodiment of the present invention is an image display apparatus according to the first embodiment in which the display is a CRT display.

A seventh embodiment of the present invention is an image display apparatus according to the first embodiment in which the display is a liquid crystal display with analogue interface.

According to the image display apparatus of the present invention, even if the timing of the image signal input from the information processor, such as a personal computer, is different from the common standard, the display resolution does not deviate on a display screen of the image display apparatus and the display attribute of the specific area can be modified.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Before describing the preferred embodiments, an explanation will be given of the conventional image display apparatus shown in FIGS. 1 to 7.

Figure 1:
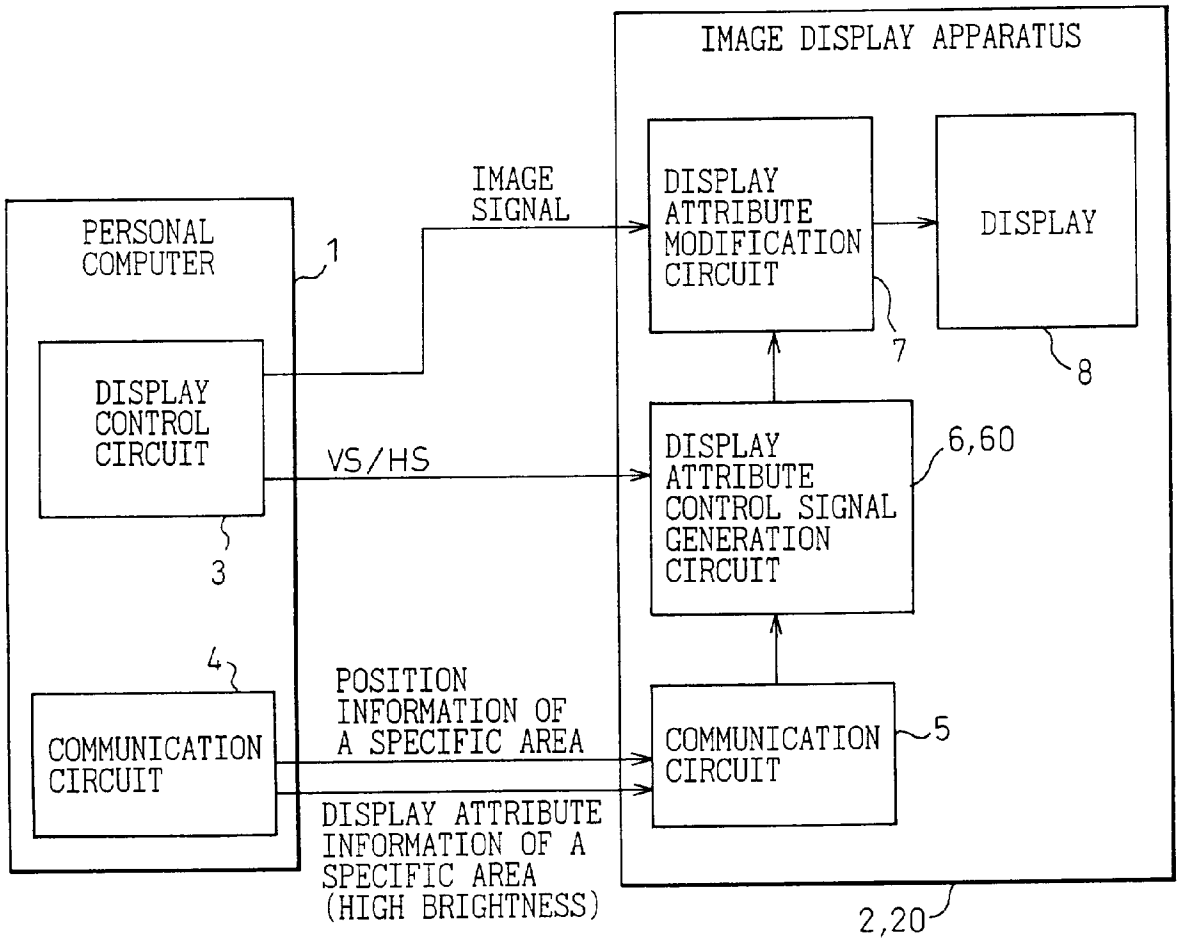
FIG. 1 is a block diagram showing a structure of a conventional image display apparatus connected to a information processor.

FIG. 1 shows a structure of the conventional image display apparatus 2 which is connected to the personal computer 1, as an information processor, via an analog interface. In this example, the image display apparatus 2 can display an image modifying the display attribute (such as contrast or brightness) of the specific area on the display screen. The personal computer 1 in this example comprises a display control circuit 3 to output an image signal and a synchronization signal, and a communication circuit 4 (such as a USB or a DDC) to output a position information of the specific area to the image display apparatus.

The image display apparatus 2 comprises a communication circuit 5 (such as a USB or a DDC) to receive a position information of the specific area from the personal computer 1, a display attribute control signal generation unit 6 which generates a display attribute control signal from the position information and the synchronization signal, a display attribute modification circuit 7 which modifies the display attribute using the display attribute control signal, and display 8 which displays an image.

There are signals such as the image signal input into the display attribute modification circuit 7 from the display control circuit 3, a vertical and a horizontal synchronization signal input to the display attribute control signal generation unit from the display control circuit 3, and position information signal and the display attribute information signal of the specific area input from the communication circuit 4 to the communication circuit 5 of the image display apparatus 2 side. The display attribute information signal of the specific area includes modification information for the display attribute (such as contrast or brightness) of the specific area on the display 8. In this conventional example, information of high brightness is output as the display attribute information of the specific area from the personal computer 1.

Figure 2:
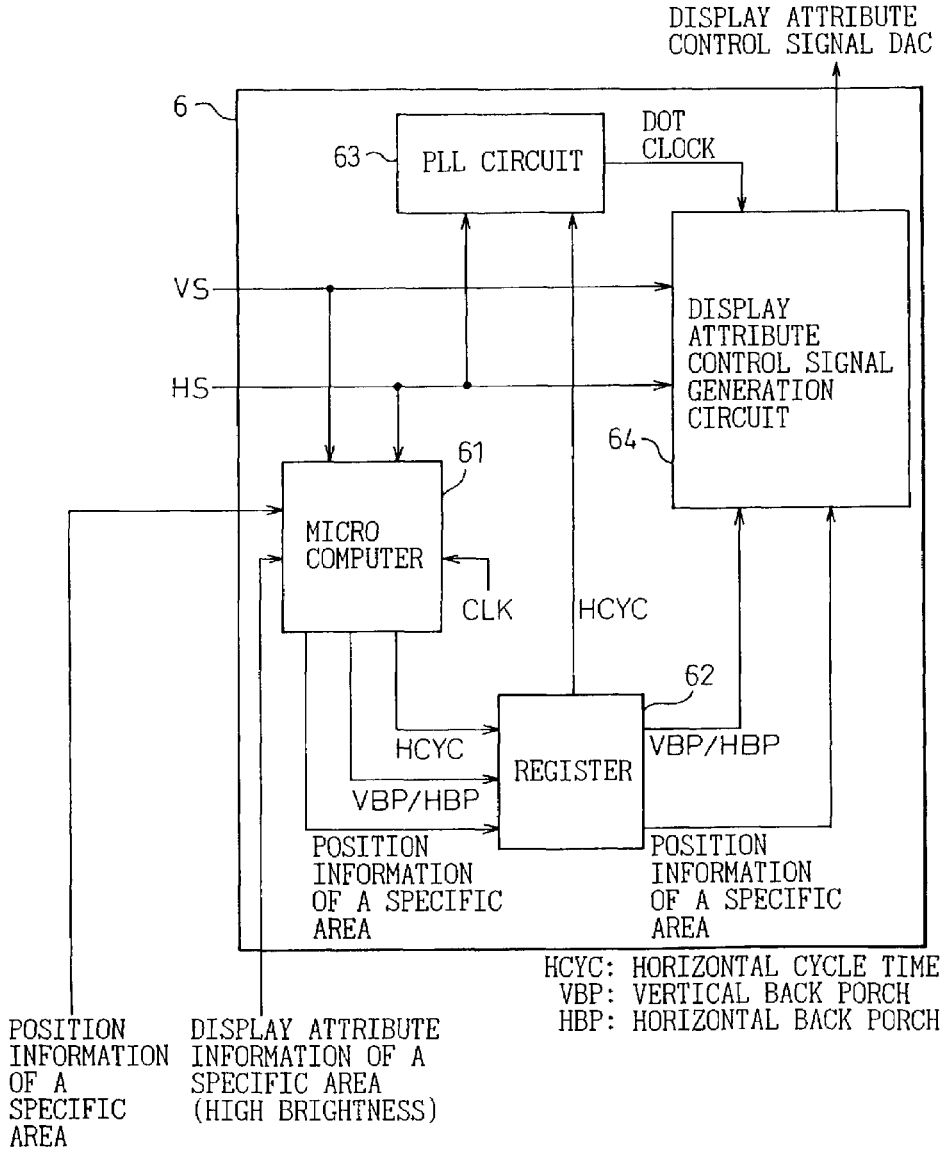
Fig. 2 PRIOR ART
FIG. 2 is a block diagram showing a structure of a display attribute control signal generation circuit of FIG. 1.

FIG. 2 is a block diagram showing an internal structure of a conventional display attribute control signal generation unit 6 of FIG. 1. The display attribute control signal generation unit 6 contains a microcomputer 61, a register 62, PLL circuit 3, and a display attribute control signal generation circuit 64. The microcomputer 61 stores position information of the specific area in the register 62 from the position information and display distribute information (high brightness, for example) of the specific area received by the communication circuit 5 shown in FIG. 1. Microcomputer 61 also determines display resolution from the timing of the vertical synchronization signal and the horizontal synchronization signal from the personal computer 1, and stores values of the horizontal cycle time HCYC, vertical back porch VBP and horizontal back porch HBP of the resolution of the displayed image in the register 62.

The register 62 comprises an HCYC register to store the value of the horizontal cycle time HCYC, a VBP register to store the value of the vertical back porch VBP, an HBP register to store the value of the horizontal back porch HBP, or the like. These HCYC register, VBP register, HBP register or the like are included in the structure the register 62.

The PLL circuit 63 generates the dot clock DC which is required when it generates the display attribute control signal from the horizontal cycle time HCYC stored in the register 62 and the horizontal synchronization signal HS sent from the personal computer 1. The display attribute control signal generation circuit 64 generates the display attribute control signal from the dot clock DC generated in the PLL circuit 63, the horizontal synchronization signal HS and vertical synchronization signal VS sent from the personal computer 1, and position information of the specific area, the vertical back porch and the horizontal back porch stored in the register 62, and send to the display attribute modification circuit 7 shown in FIG. 1.

Figure 3:
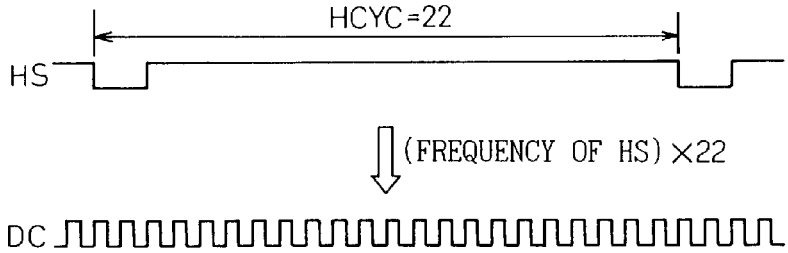
Fig.3 PRIOR ART
FIG. 3 shows a waveform for an explanation of a generation method of dot clock DC by PLL circuit of FIG. 2 as a wave form.

FIG. 3 shows a conventional method for generating a dot clock DC. The dot clock DC is made by multiplying the horizontal cycle time HCYC of the horizontal synchronization signal. A value of the horizontal cycle time HCYC is over 100 actually but, in this example, a case in which the value of the horizontal cycle time HCYC is 22 is used to make the explanation simple. In this case, the horizontal cycle time HCYC determined by the microcomputer 61 is 22, therefore, the frequency of the horizontal synchronization signal is multiplied 22 times so as to generate the dot clock DC.

Figure 4:
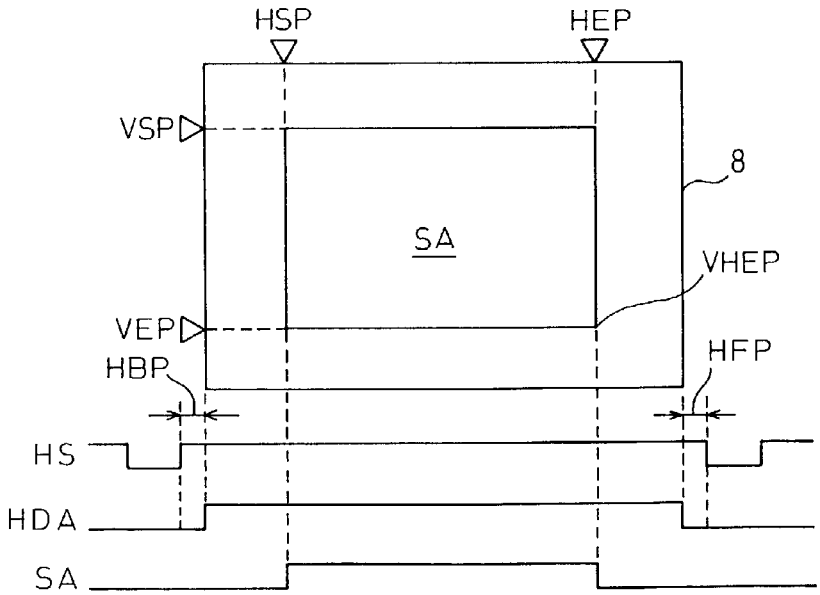
Fig.4 PRIOR ART
FIG. 4 explains a start point and end point of a specific area on the screen of the display, a horizontal synchronization signal, a data signal, and a display attribute control signal.

FIG. 4 shows a display screen of the display 8, the specific area SA to be modified its display attribute in the display screen, and corresponding signal in the conventional example. VSP shows a start point in the Y direction of the specific area SA, and VEP shows the end point in the Y direction of the specific area SA. A horizontal display area HDA is a range from a position where the horizontal back porch HPB from the beginning of one horizontal synchronization signal HS ends to a position where the horizontal front porch HFB to the ending of one horizontal synchronization signal HS starts. The horizontal ("X direction" below) start point HSP and end point HEP, and the vertical ("Y direction" below) end point is determined from the position information of the specific area SA.

Figure 5A:
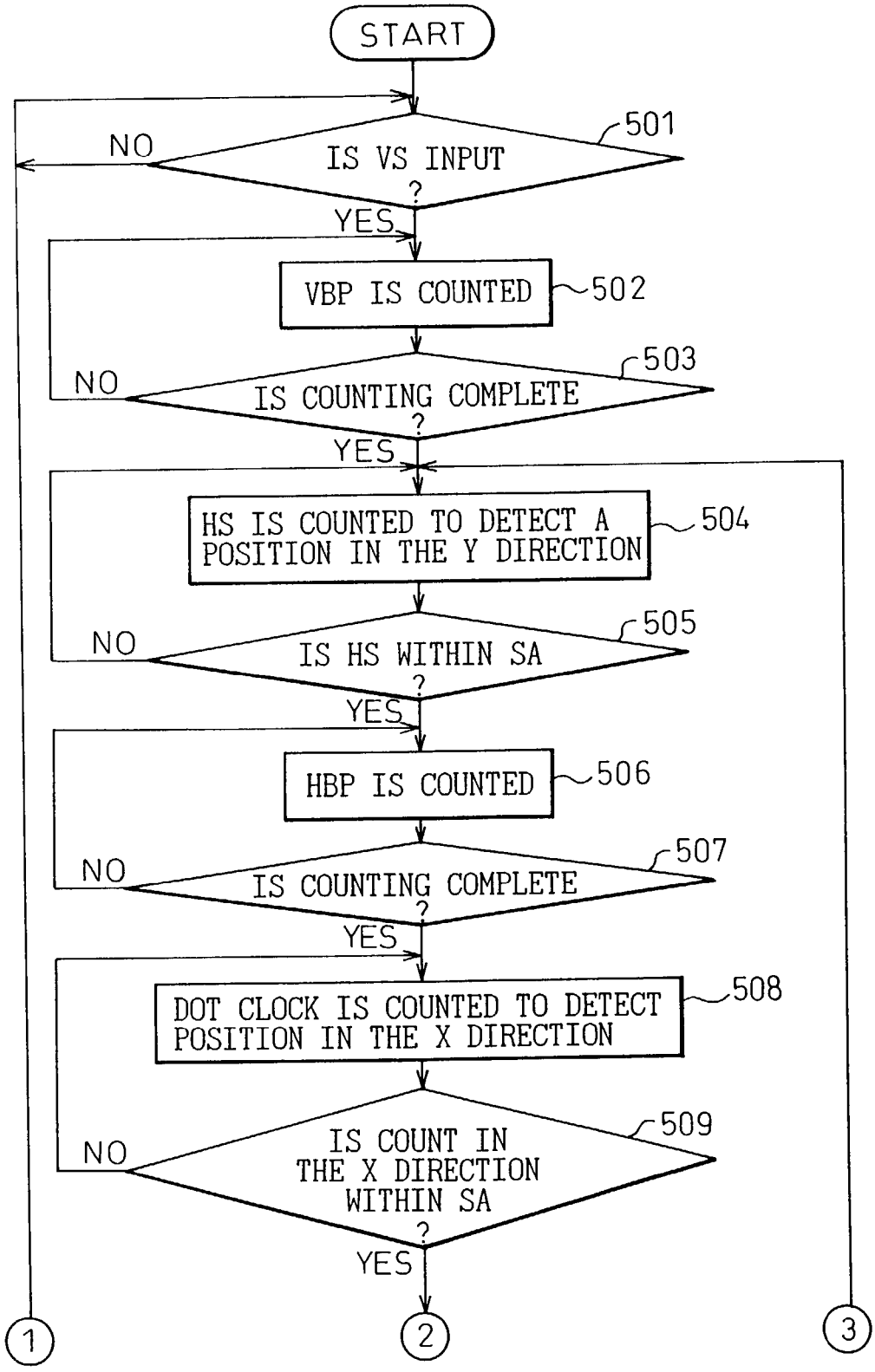
Fig.5A PRIOR ART
FIGS. 5A and 5B are flowcharts showing a conventional method for generating the display attribute control signal.
Figure 5B:
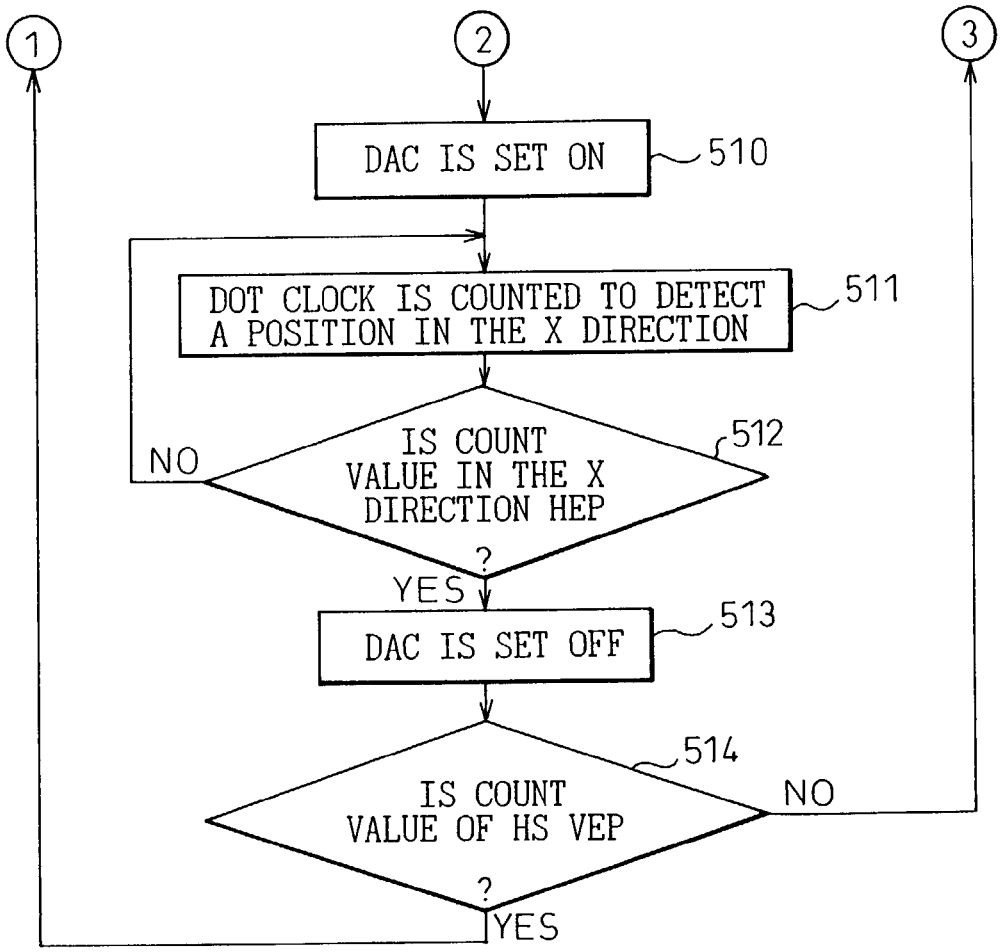
Fig.5B PRIOR ART

A method for generating the display attribute control signal in the conventional example will be explained with reference to flowcharts shown in FIGS. 5A, 5B and a waveform shown in FIG. 6.

In a step 501, it is determined whether or not the vertical synchronization signal VS is input. If not input, input of the vertical synchronization signal VS is continuously awaited. If it is determined that the vertical synchronization signal VS is input, the flow goes on to a step 502 and the vertical back porch VBP in the vertical synchronization signal VS is counted. The vertical back porch VBP is carried out by counting the number of the horizontal synchronization signal HS in the vertical synchronization signal VS. Then it is determined whether or not the counting is complete in a step 503. If the counting of vertical back porch VBP is not complete, the step 502 is repeated. If the counting of vertical back porch VBP is complete, the flow goes on to a step 504. The value of the vertical back porch VBP in the vertical synchronization signal is defined by a standard according to the display solution. An area shown by an arrow VBP in the vertical synchronization signal VS is the vertical back porch.

In a step 504, the horizontal synchronization signal HS is counted for detection a position in the Y direction of the display to detect a start point (VSP in FIG. 4) of the specific area in the Y direction. In a step 505, it is determined whether or not the counted number of the horizontal synchronization signal HS in the Y direction is in the specific area SA of FIG. 4. If not, the flow goes back to the step 504 and continues to count the horizontal synchronization signal HS. On the other hand, decision in the step 505 shows that the count number of the horizontal synchronization signal HS in the Y direction is in the specific area SA, the flow goes on to a step 506. The Y direction start point VSP shown in FIG. 6 is detected in the step 506.

In the step 506, the horizontal back porch HBP of the horizontal synchronization signal is counted. The horizontal back porch HBP can be carried out by counting the dot clock DC. In a step 507, it is determined whether or not the counting of the horizontal back porch HBP is complete. If the counting of the horizontal back porch HBP is not complete, the step 504 is repeated. If the counting of the horizontal back porch HBP is complete, the flow goes on to a step 508. The value of the horizontal back porch HBP in the horizontal synchronization signal is defined by a standard according to the display solution. An area shown by an arrow HBP in the enlarged vertical synchronization signal VS is the horizontal back porch.

In a step 508, a dot clock DC is counted. It corresponds to counting a position of the horizontal synchronization signal HS in the X direction corresponding to the X direction of the display screen. The position information of the specific area SA on the display screen is input in the display attribute control signal generation unit 6, so that it is determined whether the position in the X direction of the horizontal synchronization signal HS by the counted dot clock DC takes the value in the specific area SA of the display screen in a step 509. If the position in the X direction of the horizontal synchronization signal HS is not in the specific area SA, the process of the step 508 is repeated.

Figure 6:
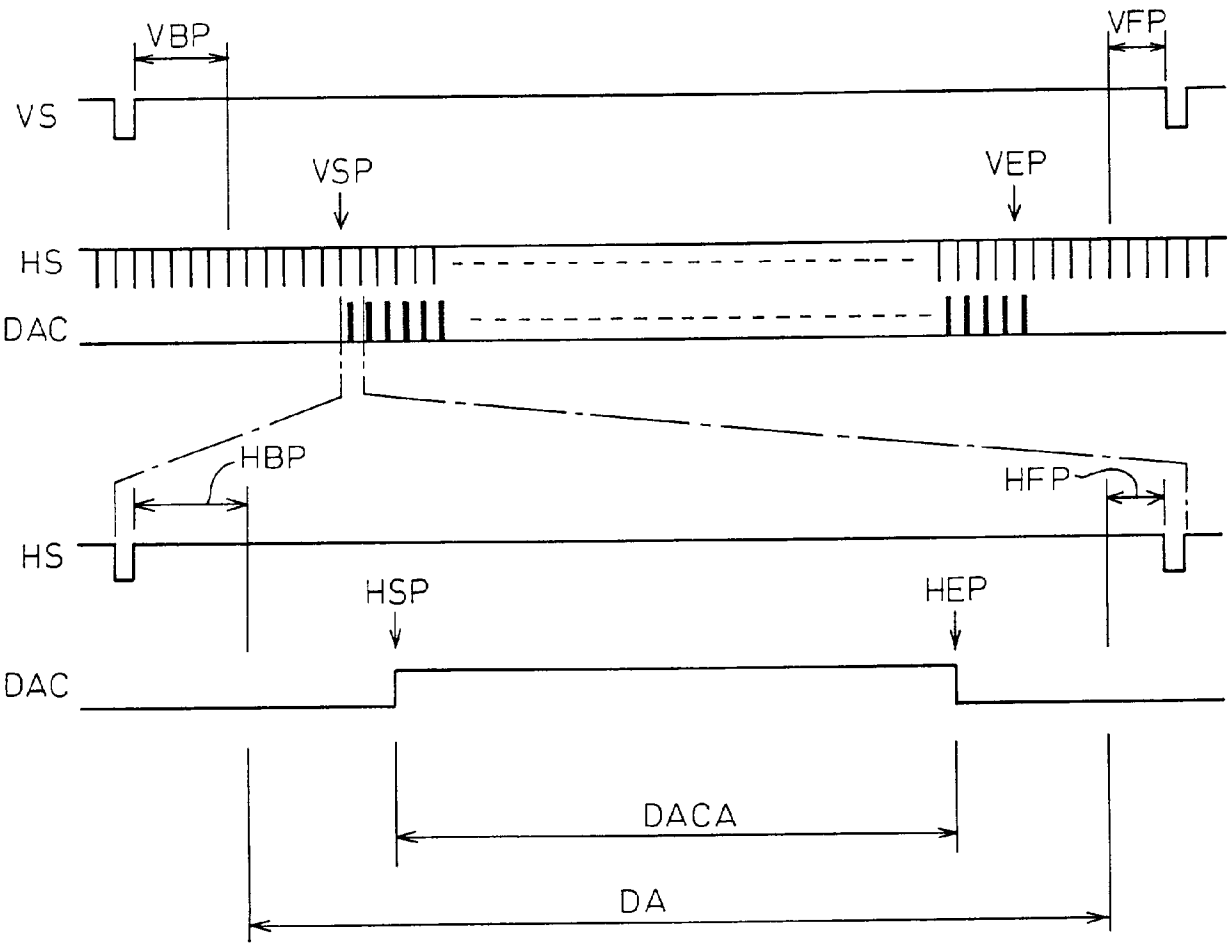
Fig.6 PRIOR ART
FIG. 6 shows a waveform for an explanation of a generation method of the display attribute control signal from a vertical synchronization signal and a horizontal synchronization signal as a wave form.

In the decision in step 509, if the counted value of the dot clock DC in the X direction is in the specific area SA, the flow goes on to a step 510, and the display attribute control signal DAC is set on as shown in FIG. 6. The point at which the display attribute control signal DAC is set on is the start point HSP in the X direction of the display attribute modification area DACA (=the specific area SA).

If the step 50 is complete, the flow goes on to a step 511 and detects a position in the X direction of the horizontal synchronization signal HS by counting the dot clock DC. In the next step 512, it is determined whether or not the count value of the dot clock DC in the X direction is an end point (end point in the X direction) VHEP of the display attribute modification area DACA. This determination is NO after the display attribute control signal DAC is set on and, therefore, the flow goes back to the step 511 and continues the counting the dot clock DC. The dot clock DC is counted until the count value of the dot clock in the X direction reaches the end point VHEP of the specific area SA. Then the flow goes on to a step 513 and the display attribute control signal DAC is set off as shown in FIG. 6. The point where the display attribute control signal DAC is set off is the end point in the X direction HEP of the display attribute modification area DACA (=the specific area SA).

After the step 513 is complete, it is determined whether or not the count value of the horizontal synchronization signal HS is the end point VEP in the Y direction on a step 514. If the count value of the horizontal synchronization signal HS is not the end point VEP in the Y direction, the flow goes back to the step 504, in which the counting of the horizontal synchronization signal HS is continued and the process from step 504 to step 509 is repeated. Thus, on or off of the display attribute modification area DACA in a screen is repeated to the end point VEP in the Y direction. If the horizontal synchronization signal HS is counted to the end point HEP in the X direction at the end point VEP in the Y direction in a picture, the flow goes back to the step 501 to wait for an input of the vertical synchronization signal VS of the next picture, and the same process as the above is repeated in the next picture.

As described above, the modification of the display attribute of the detected specific area SA is carried out based on the display attribute information of the specific area SA shown in FIG. 3, and the contrast or the brightness of the specific area SA is modified.

Figure 7:
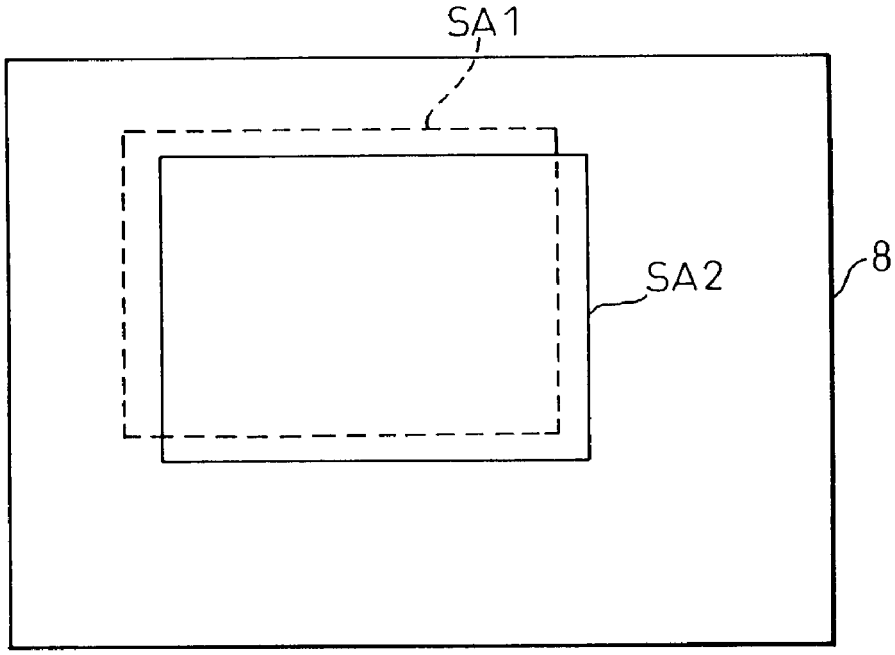
Fig. 7 PRIOR ART
FIG. 7 is an explanatory view explaining a problem in the display attribute modification of the specific area in the display screen of the conventional image display apparatus.

However, timing of the image signal input from the personal computer 1 as the information processor can be different from the predetermined standard in the conventional operation described above. For example, the horizontal cycle time can be different from the standard value, and the value of the vertical back porch VBP or the horizontal back porch HBP can be different from the standard value. If such differences occurs, a specific area SA1, represented as a broken line, whose display attribute is to be modified can be different from a specific area SA2 whose display attribute is actually modified as shown in FIG. 7.

An embodiment of a image display apparatus of the present invention, in which, if the timing of the image signal transmitted to the image display apparatus from a personal computer is different from a standard, the display attribute modification of the specific area can be correctly carried out so that the above problem can be solved, will be discussed below.

A structure of an image display apparatus 20 of an embodiment of the present invention will be explained with reference to FIG. 1. The structure of an image display apparatus 20 of the embodiment of the present invention is comprised of the communication circuit 5, the display attribute control signal generation unit 60, the display attribute modification circuit 7, and the CRT display 8, and is connected to the personal computer 1, similar to the conventional image display apparatus 2. The image display apparatus of the present invention is the same as the conventional image display apparatus 2 described in FIG. 1 except that the display attribute control signal generation unit 6 of the conventional image display apparatus 2 described in FIG. 1 is changed to the display attribute control signal generation unit 60 in which the inner structure is different. Thus, an explanation about the structure of the image display apparatus 20 except the display attribute control signal generation unit 60 of the present invention will be omitted.

Figure 8:
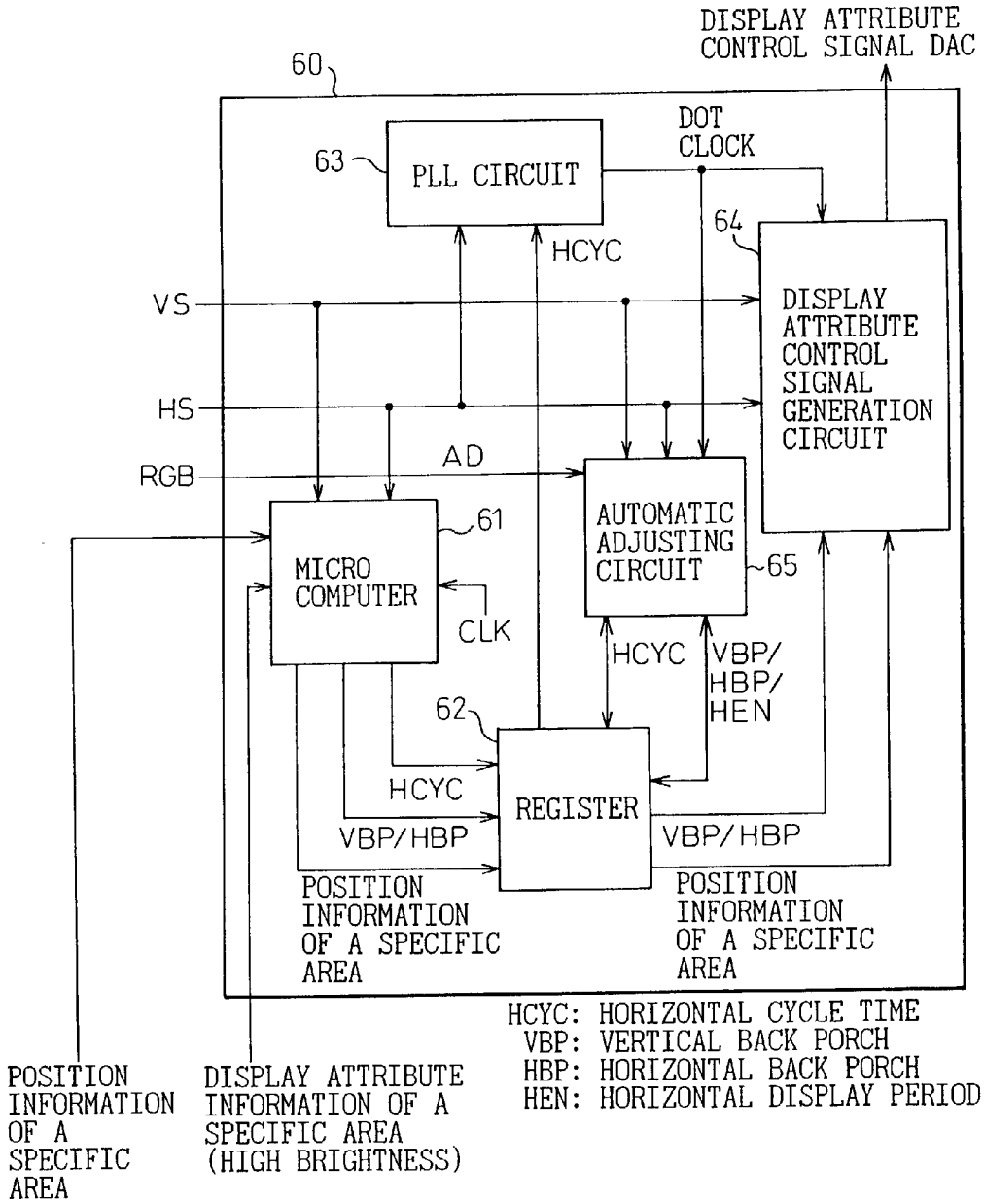
FIG. 8 is a block diagram showing a structure of the image display apparatus of the present invention.

FIG. 8 shows an inner structure of an embodiment the display attribute control signal generation unit 60 of the present invention shown in FIG. 1. The same parts as of the conventional display attribute control signal generation unit 6 is represented as the same code in the display attribute control signal generation unit 60 in FIG. 8.

The display attribute control signal generation unit 60 comprises the microcomputer 61, the register 62, the PLL circuit 63, the display attribute control signal generation circuit 64, and an automatic adjusting circuit 65. The microcomputer 61 stores the position information of the specific area which is supplied from the communication circuit 5 shown in FIG. 1 in the register 62. The microcomputer 61 determines a resolution based on the timing of the vertical synchronization signal VS and the horizontal synchronization signal HS supplied from the personal computer 1, and reads values of horizontal cycle time HCYC, vertical back porch VBP and horizontal back porch HBP the resolution from a memory which is not shown, and stores it in the register 62.

The PLL circuit 63 generates a dot clock DC, which is necessary for generating the display attribute control signal DAC, from the horizontal cycle time HCYC stored in the register 62 and the horizontal synchronization signal HC sent from the personal computer 1. The dot clock DC is input to the display attribute control signal generation circuit 64 and the automatic adjusting circuit 65. The display attribute control signal generation circuit 64 generates the display attribute control signal DAC from the dot clock DC generated in the PLL circuit 63, the horizontal synchronization signal HC and the vertical synchronization signal VS sent from the personal computer 1, the position information of the specific area SA, vertical back porch VBP and horizontal back porch stored in the register 62, and sends the same to the display attribute modification circuit 7 in FIG. 1.

Figure 10:
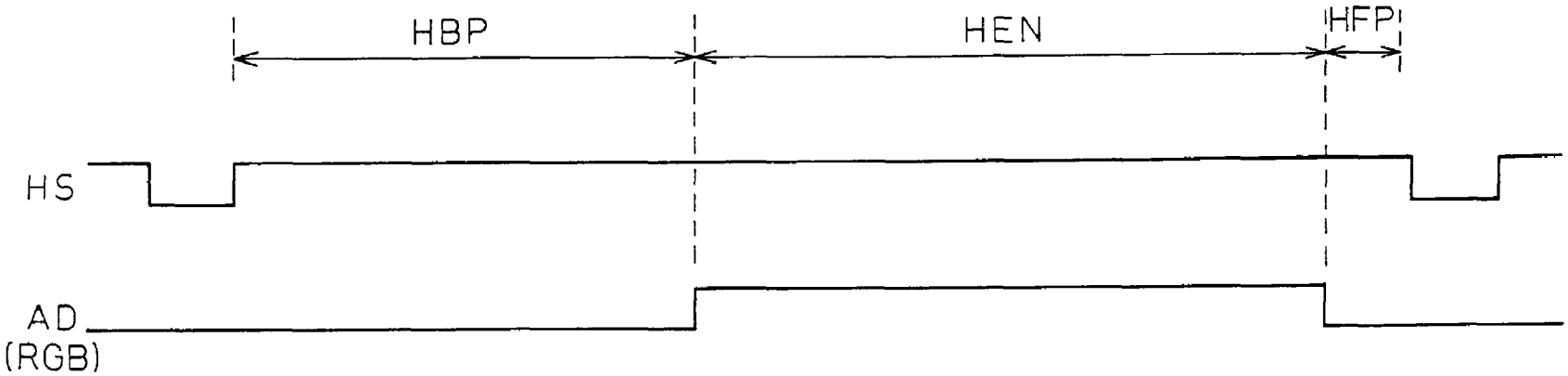
FIG. 10 shows waveforms of the horizontal synchronization signal and the automatic adjusting signal transmitted to the image display apparatus of the present invention.

The difference between the display attribute control signal generation unit 60 of the present invention and the conventional display attribute control signal generation unit 6 (FIG. 2) is provision of the automatic adjusting circuit 65 and the horizontal display period HEN stored in the register 62. In the present invention, an operation mode named automatic adjusting mode is provided. In the automatic adjusting mode, one signal of the RGB image signal is input in the automatic adjusting circuit 65. The one signal of the RGB image signal is shown in FIG. 10 in contrast with the horizontal synchronization signal HS. The signal is referred as an automatic adjusting signal AD below. The automatic adjusting signal AD is a signal between the periods of the horizontal back porch and the horizontal front porch of the horizontal synchronization signal, and indicates the horizontal display period HEN.

Figure 9A:
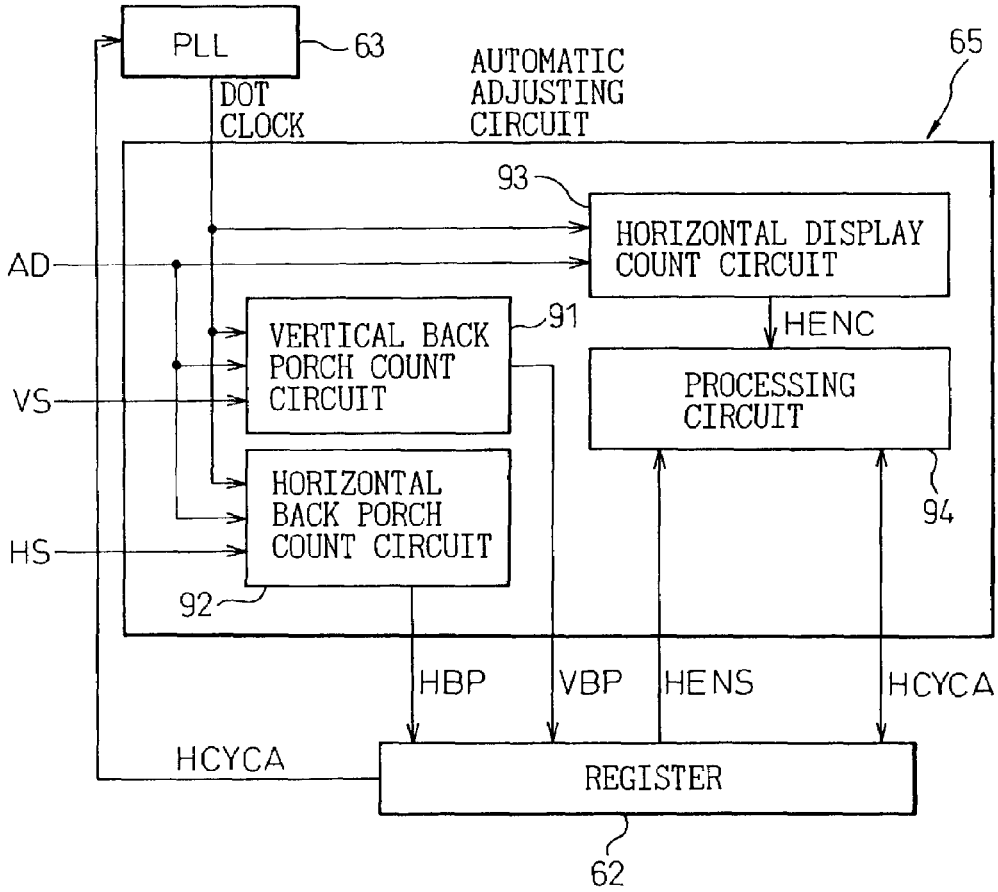
FIG. 9A is a block diagram showing a structure of an automatic adjusting circuit of FIG. 8.

FIG. 9A shows a structure of an embodiment of the automatic adjusting circuit 65. The automatic adjusting circuit 65 comprises a vertical back porch count circuit 91, horizontal back porch count circuit 92, horizontal display period count circuit 93, and a processing circuit 94. The vertical synchronization signal VS, the automatic adjusting signal AD, and the dot clock DC are input to the vertical back porch count circuit 91. The vertical back porch count circuit 91 detects a correct vertical back porch VBP by counting the vertical synchronization signal VS after adjustment of the dot clock DC, and outputs it to the register 62. The horizontal synchronization signal HS, the automatic adjusting signal AD, and the dot clock DC are input to the horizontal back porch count circuit 92. The horizontal back porch count circuit 92 detects a correct horizontal back porch HBP by counting the horizontal synchronization signal HS after adjustment of the dot clock DC, and outputs it to the register 62.

Figure 9B:
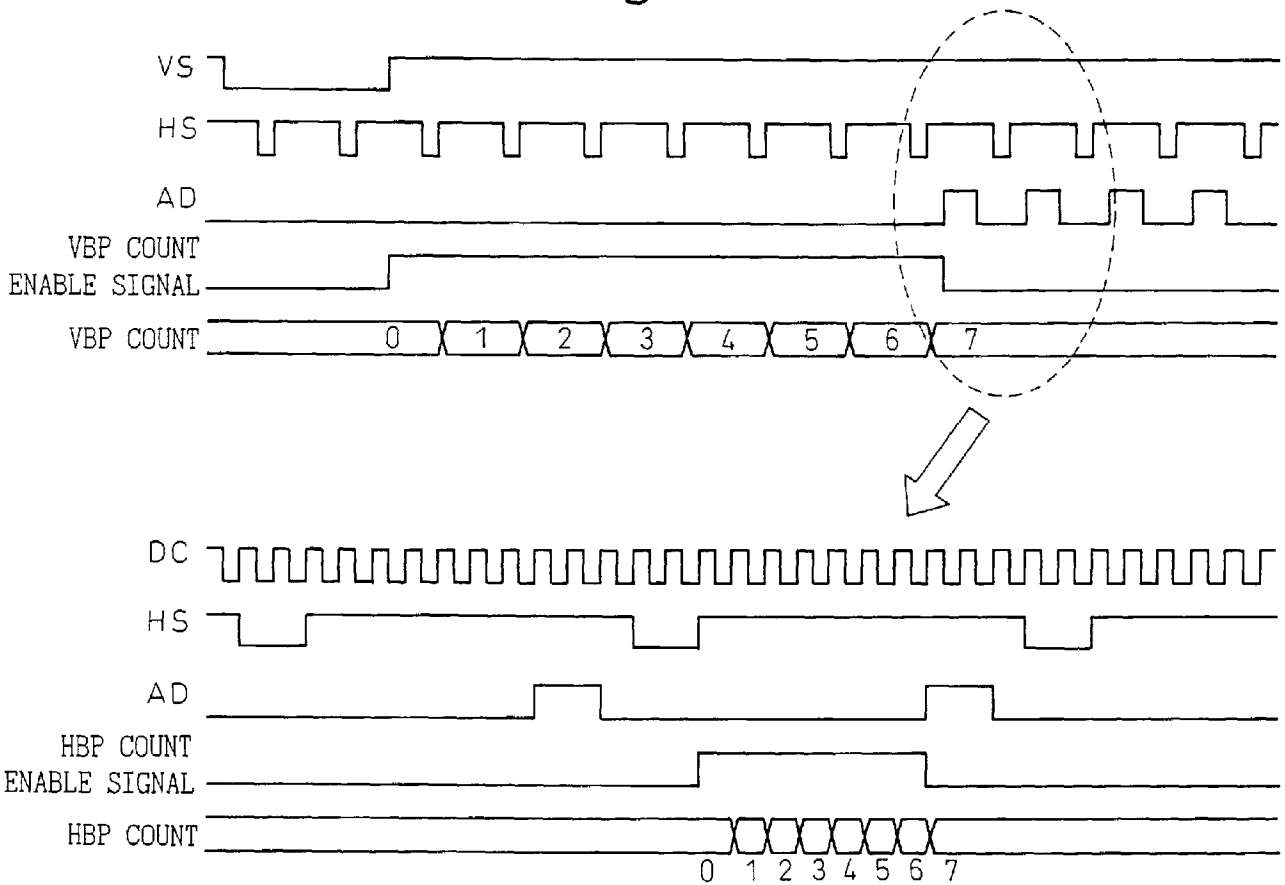
FIG. 9B shows a waveform for an explanation of a counting sequence for vertical, horizontal back porch of vertical back porch counting circuit and horizontal back porch counting circuit.

FIG. 9B explains the count of the vertical back porch VBP and the horizontal back porch HBP of the vertical back porch count circuit 91 and the horizontal back porch count circuit 92 of the automatic adjusting circuit 65. The vertical back porch count circuit 91 counts the horizontal synchronization signal HS during a period in which input vertical back porch count enable signal (not shown in FIG. 9A) is high-level (active). The counted value is the vertical back porch VBP. The horizontal back porch count circuit 92 counts the input dot clock DC during a period in which horizontal back porch count enable signal (not shown in FIG. 9A) is high-level (active). The counted value is the horizontal back porch HBP.

The vertical back porch VBP input from the vertical back porch count circuit 91 and the horizontal back porch HBP input from the horizontal back porch count circuit 92 are input to the register 62. As described above, the microcomputer 61 determines the resolution based on the timing of the vertical synchronization signal and the horizontal synchronization signal from the personal computer 1, and reads the values of the horizontal cycle time HCYC, the vertical back porch VBP and the horizontal back porch from a memory (not shown), and stores them in the register 62. Accordingly, the register 62 previously stores the resolution of the picture which is to be displayed based on the value of the vertical back porch VBP (a standard value) and the value of the horizontal back porch (a standard value). The standard value HENS of the dot clock in the horizontal display period HEN according to the resolution and the standard value HENS of the dot clock DC in the horizontal display period HEN are also stored in the register 62. The register 62 outputs the standard value HENS of the dot clock DC in the horizontal display period HEN to the processing circuit according to the input standard value of the vertical back porch VBP and the that of the horizontal back porch.

On the other hand, the automatic adjusting signal AD and the dot clock DC in the horizontal display period count circuit 93. The horizontal display period count circuit 93 counts the dot clock DC during a period in which the automatic adjusting signal AD is high-level (the horizontal display period HEN) and outputs the count value HENC to the processing circuit.

In this embodiment, the number of dot clocks is explained as the count value of the dot clock HENC in the horizontal display period HEN or the standard value HENS of the number of dot clock. The count number of the dot clocks represents a time during the horizontal display period HEN which corresponds to the number of dot clock.

The processing circuit 94 performs a process described below from the standard value HENS of the dot clock in the horizontal display period HEN input from the register 62 and the count value of the dot clock in the horizontal display period HEN input from the horizontal display period count circuit 93, to obtain a correction value HCYCA to correct a frequency of the dot clock DC generated in the PLL circuit 63. The processing circuit 94 rewrites the contents of the register 62 using the correction value HCYCA. The register 62 sends the correction value HCYCA of the dot clock sequency to the PLL circuit 63, and the PLL circuit 63 modifies the dot clock sequency (multiplied number of the horizontal synchronization signal HS) based on the correction value HCYCA.

An operation of the automatic adjusting circuit 65 in the automatic adjusting mode will be explained with reference to the flowcharts of FIGS. 11 and 12, and a waveform of FIG. 15.

Figure 11:
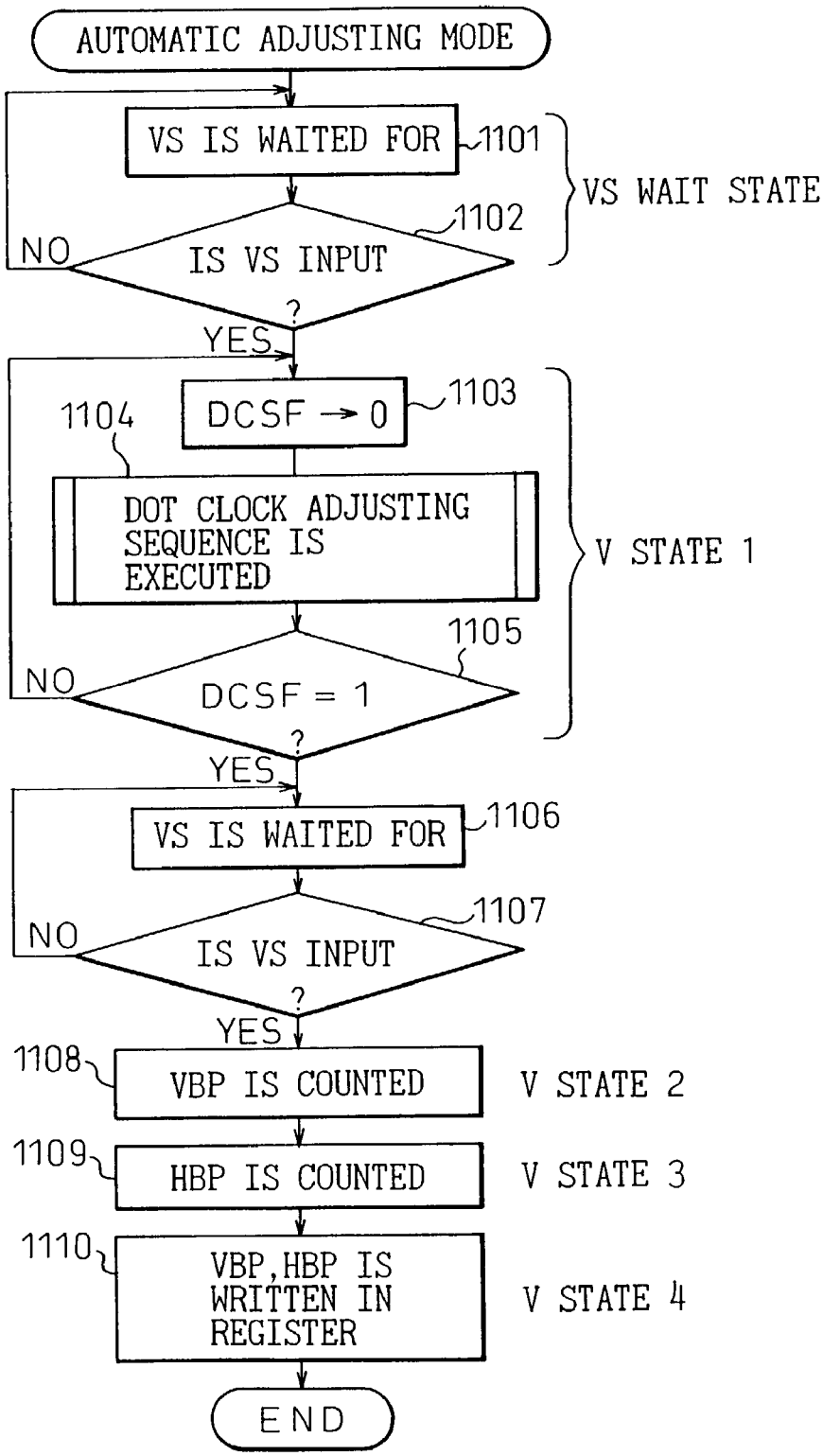
FIG. 11 is a flow chart showing, in detail, the process of the automatic adjusting mode in the image display apparatus of the present invention.
Figure 12:
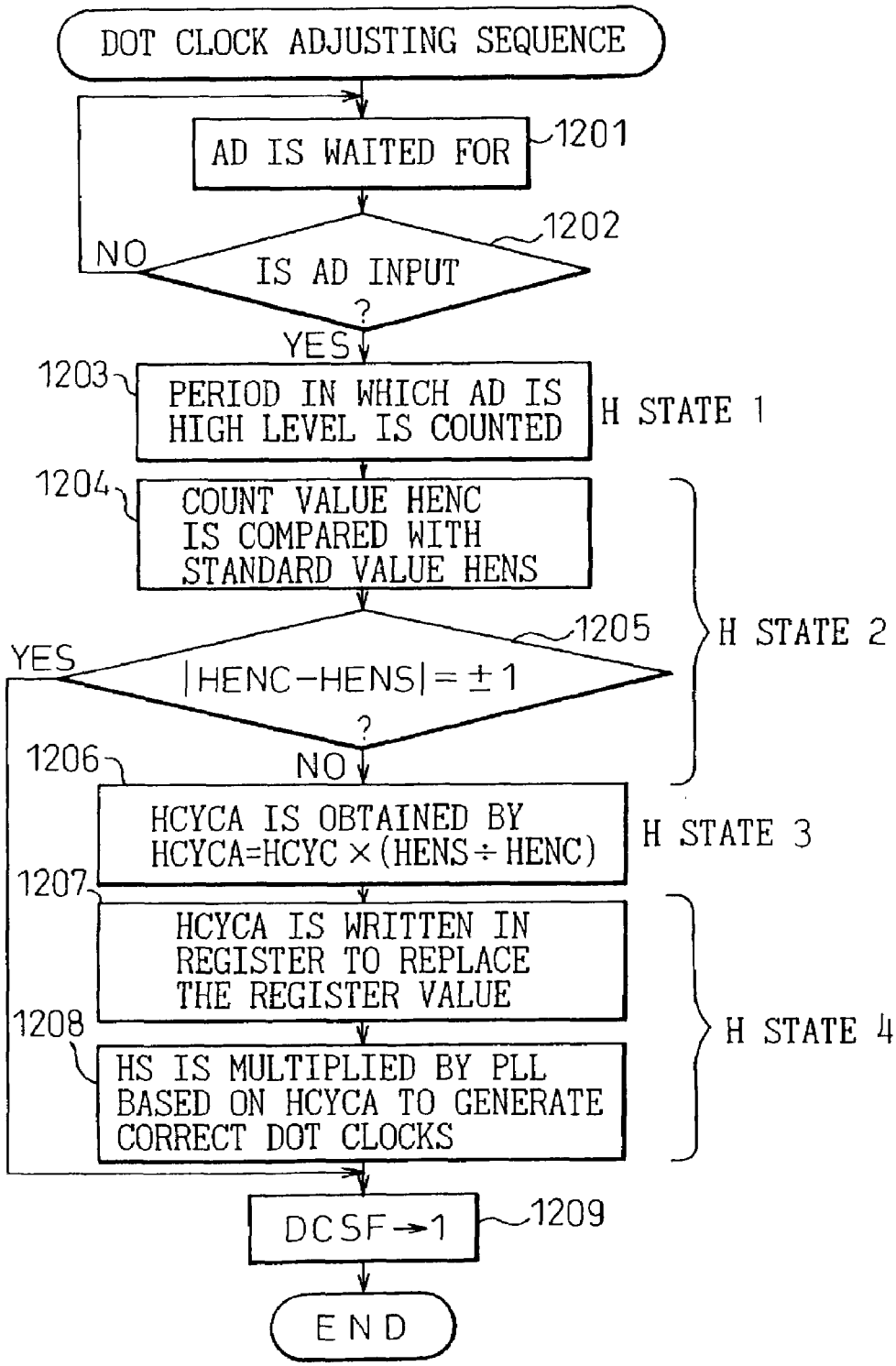
FIG. 12 is a flow chart showing a control procedure of the Step 1104 in FIG. 11.
Figure 15:
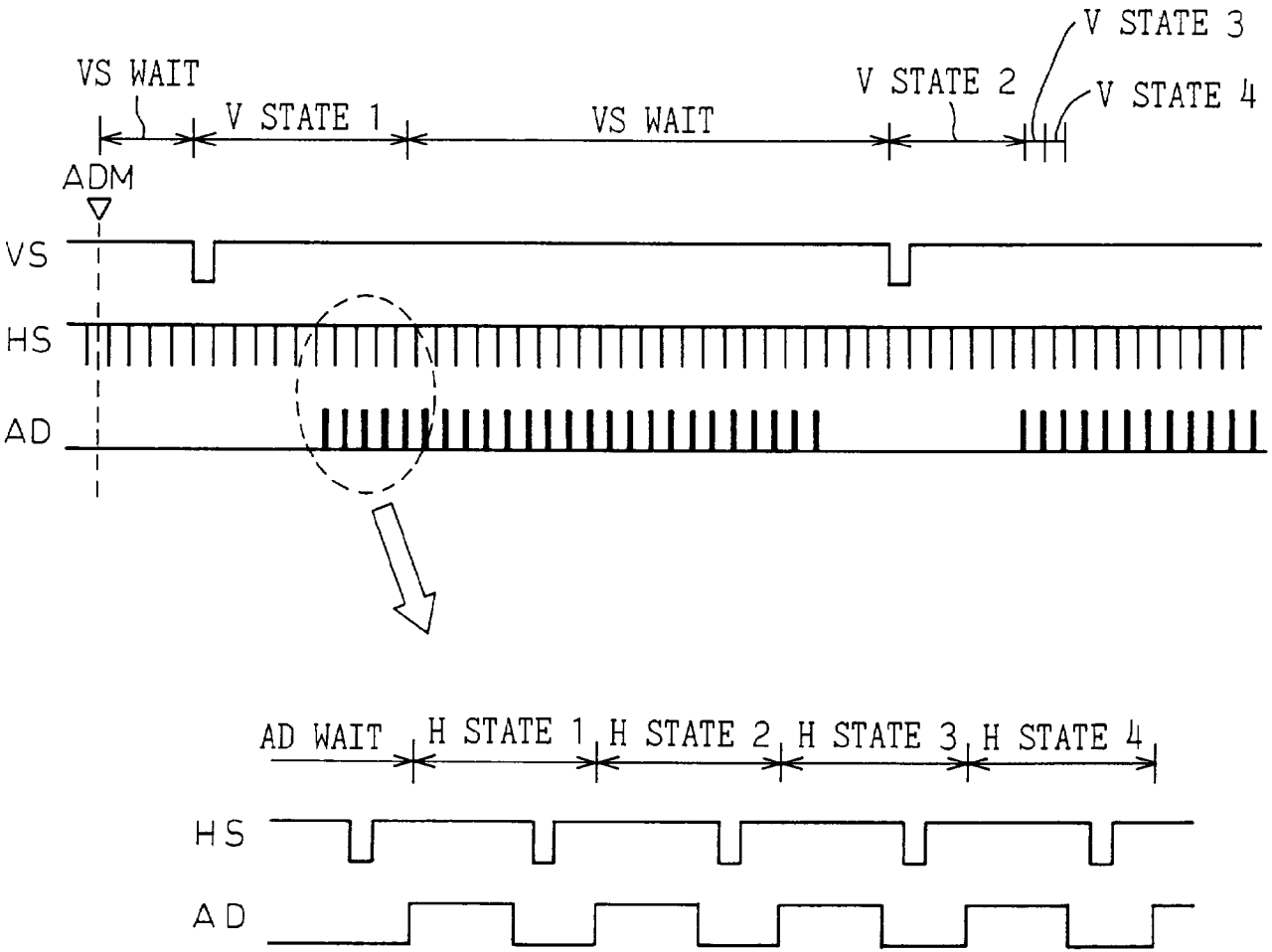
FIG. 15 is a wave form explaining the control processes of FIGS. 11 and 12.

If the process goes into the automatic adjusting mode shown as ADM in FIG. 15, a procedure shown in FIG. 11 starts. In the automatic adjusting mode, input of the vertical synchronization signal VS is awaited in step 1101. In a following step 1102, it is determined whether or not the vertical synchronization signal VS is input. The step 1101 is continued until it is determined that the vertical synchronization signal VS is input in the step 1102. If it is determined that the vertical synchronization signal VS is input in the step 1102, the flow goes on to a step 1103. This situation corresponds to a "waiting state" in FIG. 15.

In step 1103 of FIG. 11, an execution flag DCSF of a dot clock control sequence described below is cleared. The dot clock control sequence is performed in the next step 1104. In the next step 1105, it is determined whether or not the dot clock control sequence is complete from a value of the execution flag DCSF. If DCSF=1, it means that the dot clock control sequence is complete and the flow goes on to the next step 1106. If DCSF=0, the dot clock control sequence of the step 104 is continuously performed. This situation corresponds to "V state 1" of FIG. 15.

Before giving an explanation of a step 1106, dot clock control sequence (detail of the V state) will be explained with reference to FIG. 12.

In the dot clock control sequence, the automatic adjusting signal AD is awaited in step 1102 (a "waiting state" in FIG. 15). If the input of the automatic adjusting signal AD, the step goes on to a step 1203. In the step 1203, the number of dot clocks in a period (the horizontal display period) in which the automatic adjusting signal AD is high level (active) is counted ("H state 1" in FIG. 15. The number of the dot clocks counted is the HENC above described.

In the next step 1204, the standard value HENS of the is read from the register 62, and is compared with the number of the dot clock HENC actually counted in the step 1203. In the step 1205, it is determined whether the difference between the actual count number of the dot clock HENC and the standard value of the dot clock in the horizontal display period HEN is within 1 ("H state 2" in FIG. 15). If the difference between the actual count number of the dot clock HENC and the standard value of the dot clock in the horizontal display period HEN is within 1, the frequency generated in the PLL circuit 63 is deemed to be correct. The flow then goes on to step 1209 and the value of the dot clock control execution flag DCSF is set "1" and this routine is finished.

On the other hand, if the difference between the actual count number of the dot clock HENC and the standard value of the dot clock in the horizontal display period HEN is larger than 1 in the step 1205, the step foes on to a step 1206. In the step 1206, the correction value HCYCA of the horizontal cycle time HCYC is processed by the expression below.

$$HCYCA=HCYC\times(HENS\div HENC) \quad \ldots H \text{ state } 3$$

After the correction value HCYCA of the horizontal cycle time HCYC is processed as described above, the correction value HCYCA is written in the register 62 and updates it in the next step 1207. The correction value HCYCA is transmitted to the PLL circuit 63 from the register 62. In the next step 1208, the PLL circuit 63 multiplies the horizontal synchronization signal HS based on the correction value HCYCA so that a correct dot clock is generated ("H state 4" in FIG. 15. In the next step 1209, the value of the execution flag DCSF of the dot clock control sequence is set "1" and the routine is finished.

If the dot clock control sequence is completed, step 1106 of FIG. 11 is carried out and the next vertical synchronization signal VS is awaited (a "VS waiting state" in FIG. 15). If it is determined that the next vertical synchronization signal VS is input in step 1107, the vertical back porch VBP is counted by the horizontal synchronization signal ("V state 2" in FIG. 15) in a step 1108. The horizontal back porch HBP is counted by the corrected number of the dot clock ("V state 3" in FIG. 15). The horizontal back porch HBP and the vertical back porch VBP are written in the register 62 ("V state 4" in FIG. 15), and this routine is complete.

As described above, the ratio of the dot clock count value HENC counted by the dot clock generated in the PLL circuit 63 during the automatic adjusting signal AD is high level and the standard value HENS of the dot clock written in the register 62 during the horizontal display period is multiplied by the horizontal cycle time HCYC so that the actual horizontal cycle time HCYCA is obtained. The obtained value HCYCA is written in the register 62. Then the horizontal synchronization signal HS is multiplied by the actual horizontal cycle time HCYCA so that accurate dot clock DC can be generated. This accurate dot clock DC is used to detect the actual vertical back porch VBP and the horizontal back porch HBP, which are used to generate the display attribute control signal DAC. Therefore, the display attribute of the accurate specific area can be modified without positional difference.

The example of controlling the dot clock DC in the image display apparatus of the present invention described above will be explained with concrete numbers by FIGS. 13 and 14. In this example, a case in which the accurate horizontal cycle time HCYC is "30", and the horizontal display time HEN is 15, i.e., the standard value of the dot clock number in the horizontal display period is "15", the horizontal cycle time HCYC of the display mode determined by the microcomputer 61 of the image display apparatus 20 is "20", and the horizontal display period is "15", is explained.

Figure 13:
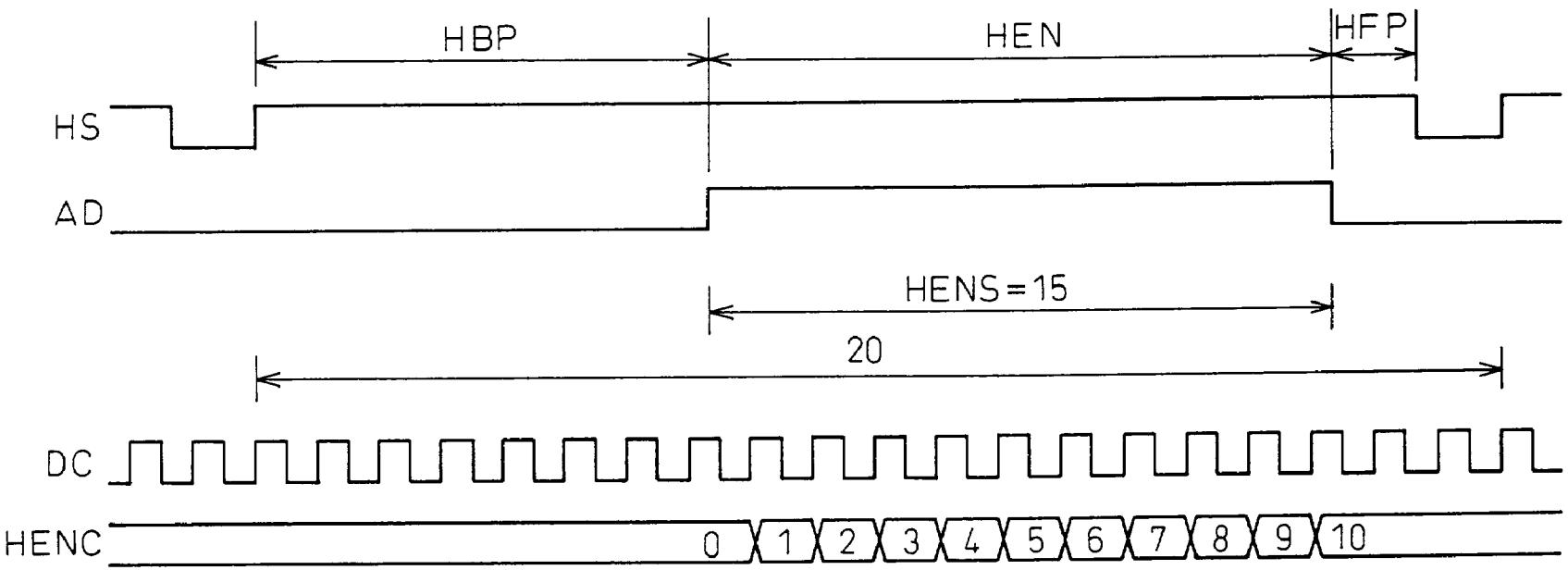
FIG. 13 shows wave forms of the horizontal synchronization signal used for checking appropriateness of the dot clock generated in the image display apparatus of the present invention, the automatic adjusting signal, a waveform of the dot clock DC, and a count value of the dot clock DC.
Figure 14:
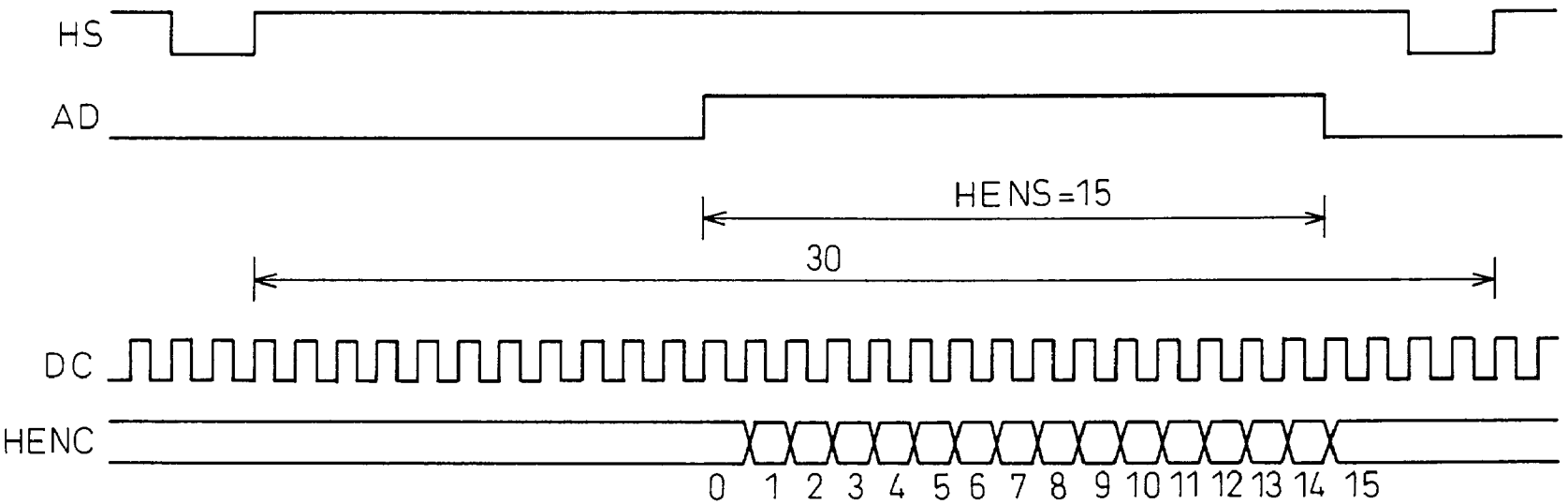
FIG. 14 shows wave forms of the horizontal synchronization signal after being corrected by the dot clock DC generated in the image display apparatus of the present invention, the automatic adjusting signal, a waveform of the dot clock DC, and a count value of the dot clock DC.

As shown in FIG. 13, the horizontal cycle time HCYC of the display mode determined by the microcomputer 61 is "20" and the horizontal display period is "15". Therefore, the dot clock is generated so that one cycle of the horizontal synchronization signal HS is 20 clock by the PLL circuit 63. Under these circumstances, a period during the automatic adjusting signal AD is high level (active) is counted based on the dot clock DC and the obtained number HENC was "10".

In this case, HENS−HENC=15−10=5, which is not within tolerance ±1, and therefore the result of the determination in the step 1205 is "NO" and the result of the step 1206 becomes HCYCA=20×15/10=30. Accordingly, one cycle of the horizontal synchronization signal HS pf the PLL circuit 63 is generated as 30 clock by process in the step 1208. As a result, the horizontal cycle time HCYC becomes "30" and the count number HENC of the dot clock becomes "15". In this case, the standard value HENS of the count number of the dot clock in the horizontal display period HEN is "15" and coincides with the count value HENC of the dot clock "15", therefore, an accurate dot clock DC can be generated.

As described above, according to the present invention, if the timing of the image signal input from the information processor of the personal computer is different from the standard, the display attribute of the specific area can be modified without misalignment the display position.

What is claimed is:

1. An image display apparatus in which a display attribute of a specific area of a display of the display apparatus is modifiable based on an image signal input from an information processor, vertical and horizontal synchronization signals, and position information and display attribute information of the specific area, comprising:

a resolution determination circuit which determines the resolution of the specific area of the display, based on the input vertical and horizontal synchronization signals, a dot clock generation circuit which generates dot clocks by multiplying the horizontal synchronization signal according to the determined resolution of the image, a horizontal display period detection circuit which detects a horizontal display period in one horizontal synchronization signal, using a signal in the image signal input from the information processor, dot clock counting circuit which actually counts the number of the dot clocks detected in the horizontal display period, a dot clock standard value reading circuit which reads a standard value of the number of the dot clocks in the horizontal display period in a line at the determined resolution of the displayed image, and a correction circuit receiving inputs from the dot clock counting circuit and the dot clock standard value reading circuit and correcting the multiplication number in the dot clock generation circuit so that the actually counted dot clock number is identical to the standard value.

2. An image display apparatus according to claim 1 in which one signal of the image signals for detecting the horizontal display period in one horizontal synchronization signal is one of the RGB signals.

3. An image display apparatus according to claim 1 in which, if the number of the counted dot clocks is different from the standard value, the correction circuit judges that the number of the counted dot clocks is equal to the standard value.

4. An image display apparatus according to claim 3 in which the difference between the number of the counted dot clocks and the standard value corresponds to one pulse of the dot clock.

5. An image display apparatus according to claim 1 in which the multiplication number is corrected by the correction circuit by dividing the standard value of the dot clock number by the actually counted number of the dot clocks, and multiplies the quotient by a current multiplication number of the dot clocks to thereby obtain a multiplication number.

6. An image display apparatus according to claim 1 in which the display is a CRT display.

7. An image display apparatus according to claim 1 in which the display is a liquid crystal display with an analogue interface.

8. A method of modifying a display attribute of a specific area of a display based on an input image signal input, input vertical and horizontal synchronization signals, and input position information and display attribute information of the specific area, comprising:

determining the resolution of the specific area of the display, based on the input vertical and horizontal synchronization signals, generating dot clocks by multiplying the horizontal synchronization signal according to the determined resolution of the image, detecting a horizontal display period in one horizontal synchronization signal, using a signal in the image signal input from the information processor, actually counting the number of the dot clocks detected in the horizontal display period, reading a standard value of the number of the dot clocks in the horizontal display period in a line at the determined resolution of the displayed image, and correcting a multiplication number in a dot clock generation circuit so that the actually counted dot clock number is identical to a standard value.

* * * * *